United States Patent [19]

Ozawa

[11] Patent Number: 5,018,200

[45] Date of Patent: May 21, 1991

[54] COMMUNICATION SYSTEM CAPABLE OF IMPROVING A SPEECH QUALITY BY CLASSIFYING SPEECH SIGNALS

[75] Inventor: Kazunori Ozawa, Tokyo, Japan

[73] Assignee: NEC Corporation, Tokyo, Japan

[21] Appl. No.: 410,459

[22] Filed: Sep. 21, 1989

[30] Foreign Application Priority Data

Sep. 21, 1988 [JP] Japan ..... 63-237727
Dec. 13, 1988 [JP] Japan ..... 63-316040

[51] Int. Cl.[5] ..... G10L 7/02
[52] U.S. Cl. ..... 381/36
[58] Field of Search ..... 381/29-41; 364/513.5

[56] References Cited

U.S. PATENT DOCUMENTS 4,776,015 10/1988 Takeda et al. ..... 381/41
4,821,324 4/1989 Ozawa et al. ..... 381/31
4,881,267 11/1989 Taguchi ..... 381/40

*Primary Examiner*—Gary V. Harkcom
*Assistant Examiner*—John Merecki
*Attorney, Agent, or Firm*—Sughrue, Mion, Zinn, Macpeak & Seas

[57] ABSTRACT

A communication system having an encoder device used in combination with a decoder device for encoding a sequence of digital speech signals into a sequence of output signals, using a spectrum parameter and a pitch parameter. A subsidiary parameter of the digital speech signals is detected and monitored by a monitoring circuit. Digital speech signals are classified into voiced sound or voiceless sound and into vocality, nasal, fricative, or explosive durations at every frame. When a voiced sound, i.e., a vocality is detected, a predetermined number of excitation pulses are calculated during a representative subframe and are produced as primary sound source signals. A subsidiary information signal is produced during the remaining subframes to represent phase and amplitude correction factors in each of the subframes. When a voiceless sound, i.e., the nasal, the fricative, or the explosive is detected, noise signals and/or a plurality of excitation pulses are calculated for each frame and produced as secondary sound source signals.

7 Claims, 5 Drawing Sheets

COMMUNICATION SYSTEM CAPABLE OF IMPROVING A SPEECH QUALITY BY CLASSIFYING SPEECH SIGNALS

BACKGROUND OF THE INVENTION

This invention relates to a communication system which comprises an encoder device for encoding a sequence of digital speech signals into a set of excitation pulses and/or a decoder device communicable with the encoder device.

As known in the art, a conventional communication system of the type described is used for transmitting a speech signal at a low transmission bit rate, such as 4.8 kb/s, from a transmitting end to a receiving end. The transmitting and the receiving ends are comprised of an encoder device and a decoder device which are operable to encoder and decode the speech signals, respectively, in the manner which will be described more in detail. A wide variety of such systems have been proposed to improve speech quality reproduced in the decoder device and to reduce the transmission bit rate.

Among others, a pitch interpolation multi-pulse system has been proposed in Japanese Unexamined Patent Publications Nos. Syô 61-15000 and 62-038500, namely, 15000/1986 and 038500/1987 which may be called first and second references, respectively. In this pitch interpolation multi-pulse system, the encoder device is supplied with a sequence of digital speech signals at every frame of, for example, 20 milliseconds and extracts a spectrum parameter and a pitch parameter which will be called first and second primary parameters, respectively. The spectrum parameter is representative of a spectrum envelope of a speech signal specified by the digital speech signal sequence while the pitch parameter is representative of a pitch of the speech signal. Thereafter, the digital speech signal sequence is classified into a voiced sound and an unvoiced sound which last for voiced and unvoiced durations, respectively. In addition, the digital speech signal sequence is divided at every frame into a plurality of pitch durations which may be referred to as subframes, respectively. Under the circumstances, operation is carried out in the encoder device to calculate a set of excitation pulses representative of a sound source signal specified by the digital speech signal sequence.

More specifically, the sound source signal for the voiced duration is represented by the excitation pulse set which is calculated with respect to a selected pitch durations that may be called a representative duration. From this fact, it should be understood that each set of the excitation pulses is extracted from an intermittent subframe. Subsequently, an amplitude and a location of each excitation pulse of the set are transmitted from the transmitting end to the receiving end along with the spectrum and the pitch parameters. On the other hand, a sound source signal of a single frame for the unvoiced duration is represented by a small number of excitation pulses and a noise signal. Thereafter, an amplitude and a location of each excitation pulse is transmitted for the unvoiced duration together with a gain and an index of the noise signal. At any rate, the amplitudes and the locations of the excitation pulses, the spectrum and the pitch parameters, and the gains and the indices of the noise signals are sent as a sequence of output signals from the transmitting end to the receiving end, comprising a decoder device.

On the receiving end, the decoder device is supplied with the output signal sequence as a sequence of reception signals which carries information related to sets of excitation pulses extracted from frames, as mentioned above. Consider a current set of excitation pulses extracted from a representative duration of a current frame and a next set of excitation pulses extracted from a representative duration of a next frame following the current frame. In this event, interpolation is carried out for the voiced duration by the use of the amplitudes and the locations of the current and the next sets of the excitation pulses to reconstruct excitation pulses in the remaining subframes except the representative durations and to reproduce a sequence of driving sound source signals for each frame. On the other hand, a sequence of driving sound source signals for each frame is reproduced for an unvoiced duration by the use of indices and gains of the excitation pulses and the noise signals.

Thereafter, the driving sound source signals thus reproduced are given to a synthesis filter formed by the use of a spectrum parameter and are synthesized into a synthesized sound signal.

With this structure, each set of the excitation pulses is intermittently extracted from each frame in the encoder device and is reproduced into the synthesized sound signal by an interpolation technique in the decoder device. Herein, it is to be noted that an intermittent extraction of the excitation pulses makes it difficult to reproduce the driving sound source signal in the decoder device at a transient portion at which the sound source signal is changed in its characteristic. Such a transient portion appears when a vowel is changed to another vowel on concatenation of vowels in the speech signal and when a voiced sound is changed to another voiced sound. In a frame including such a transient portion, the driving sound source signals reproduced by the use of the interpolation technique is terribly different from actual sound source signals, which results in degradation of the synthesized sound signal in quality.

Furthermore, the above-mentioned pitch interpolation multi-pulse system is helpful to conveniently represent the sound source signals, when the sound source signals have distinct periodicity. However, the sound source signals do not practically have distinct periodicity at a nasal portion within the voiced duration. Therefore, it is difficult to correctly or completely represent the sound source signals at the nasal portion by the pitch interpolation multi-pulse system.

On the other hand, it has been confirmed by a perceptual experiment that the transient portion and the nasal portion are very important for perceptivity of phonemes and for perceptivity of naturality or natural feeling. Under the circumstances, it is readily understood that a natural sound cannot be reproduced for the voiced duration by the conventional pitch interpolation multi-pulse system because of an incomplete reproduction of the transient and the nasal portions.

Moreover, the sound source signals are represented by a combination of the excitation pulses and the noise signals for the unvoiced duration in the above-mentioned system, as described before. It has been known that a sound source of a fricative is also represented by a noise signal during a consonant appearing for the voiced duration. This means that it is difficult to reproduce a synthesized sound signal of a high quality when the speech signals are classified into two species of sounds, such as voiced and unvoiced sounds.

It is mentioned here that the spectrum parameter for a spectrum envelope is generally calculated in an encoder device by analyzing the speech signals by the use of a linear prediction coding (LPC) technique and is used in a decoder device to form a synthesis filter. Thus, the synthesis filter is formed by the spectrum parameter derived by the use of the linear prediction coding technique and has a filter characteristic determined by the spectrum envelope. However, when female sounds, in particular, "i" and "u" are analyzed by the linear prediction coding technique, it has been pointed out that an adverse influence appears in a fundamental wave and in the harmonic waves of a pitch frequency. Accordingly, the synthesis filter has a band width which is very narrower than a practical band width determined by a spectrum envelope of practical speech signals. Particularly, the band width of the synthesis filter becomes extremely narrow in a frequency band which corresponds to a first formant frequency band. As a result, no periodicity of a pitch appears in a reproduced sound source signal. Therefore, a speech quality of the synthesized sound signal is unfavorably degraded when the sound source signals are represented by the excitation pulses extracted by the use of the interpolation technique on the assumption of the periodicity of the sound source.

SUMMARY OF THE INVENTION

It is an object of this invention to provide a communication system which is capable of improving the speech quality when digital speech signals are encoded at a transmitting end and reproduced at a receiving end.

It is another object of this invention to provide an encoder which is used in the transmitting end of the communication system and which can encode the digital speech signals into a sequence of output signals with a comparatively small amount of calculation so as to improve the speech quality.

It is still another object of this invention to provide a decoder device which is used in the receiving end and which can reproduce a synthesized sound signal at a high speech quality.

An encoder device to which this invention is applicable is supplied with a sequence of digital speech signals at every frame to produce a sequence of output signals. The encoder device comprises of a parameter calculation circuit responsive to the digital speech signals for calculating first and second primary parameters which specify a spectrum envelope and a pitch of the digital speech signals at every frame to produce first and second parameter signals representative of the spectrum envelope and the pitch, respectively, primary calculation means coupled to the parameter calculation means for calculating a set of calculation result signals representative of the digital speech signals, and output signal producing means for producing the set of the calculation result signals as the output signal sequence. According to an aspect of this invention, the encoder device comprises subsidiary parameter monitoring means operable in cooperation with the parameter calculation means for monitoring a subsidiary parameter which is different from the first and the second primary parameters to specify the digital speech signals at every frame. The subsidiary parameter monitoring means thereby produces a monitoring result signal representative of a result of monitoring the subsidiary parameter. The primary calculation means comprises processing means supplied with the digital speech signals, the first and the second primary parameter signals, and the monitoring result signal for processing the digital speech signals to selectively produce a first set of primary sound source signals and a second set of secondary sound source signals different from the first set of the primary sound source signals. The first set of the primary sound source signals is formed by a set of excitation pulses calculated with respect to one of the subframes selected, which results from dividing every frame in dependency upon the second primary parameter signal and each of which is shorter than the frame and a subsidiary information signal calculated with respect to the remaining subframes except the one of the subframes selected on production of the set of the excitation pulses. The primary calculation means further comprises means for supplying a combination of the primary and the secondary sound source signals to the output signal producing means as the calculation result signals.

A decoder device is communicable with the encoder device mentioned above to produce a sequence of synthesized speech signals. The decoder device is supplied with the output signal sequence as a sequence of reception signals which carries the primary sound source signals, the secondary sound source signals, the first and the second primary parameters, and the subsidiary parameter. According to another aspect of this invention, the decoder device comprises demultiplexing means supplied with the reception signal sequence for demultiplexing the reception signal sequence into the primary and the secondary sound source signals, the first and the second primary parameters, and the subsidiary parameter as primary and secondary sound source codes, first and second parameter codes, and a subsidiary parameter code, respectively. The primary sound source codes convey the set of the excitation pulses and the subsidiary information signal which are demultiplexed into excitation pulse codes and a subsidiary information code, respectively. The decoder device further comprises reproducing means coupled to the demultiplexing means for reproducing the primary and the secondary sound source codes into a sequence of driving sound source signals by using the subsidiary information signal, the first and the second parameter codes, and the subsidiary parameter code, and means coupled to the reproducing means for synthesizing the driving sound source signals into the synthesized speech signals.

DESCRIPTION OF THE PREFERRED EMBODIMENTS

Figure 1:
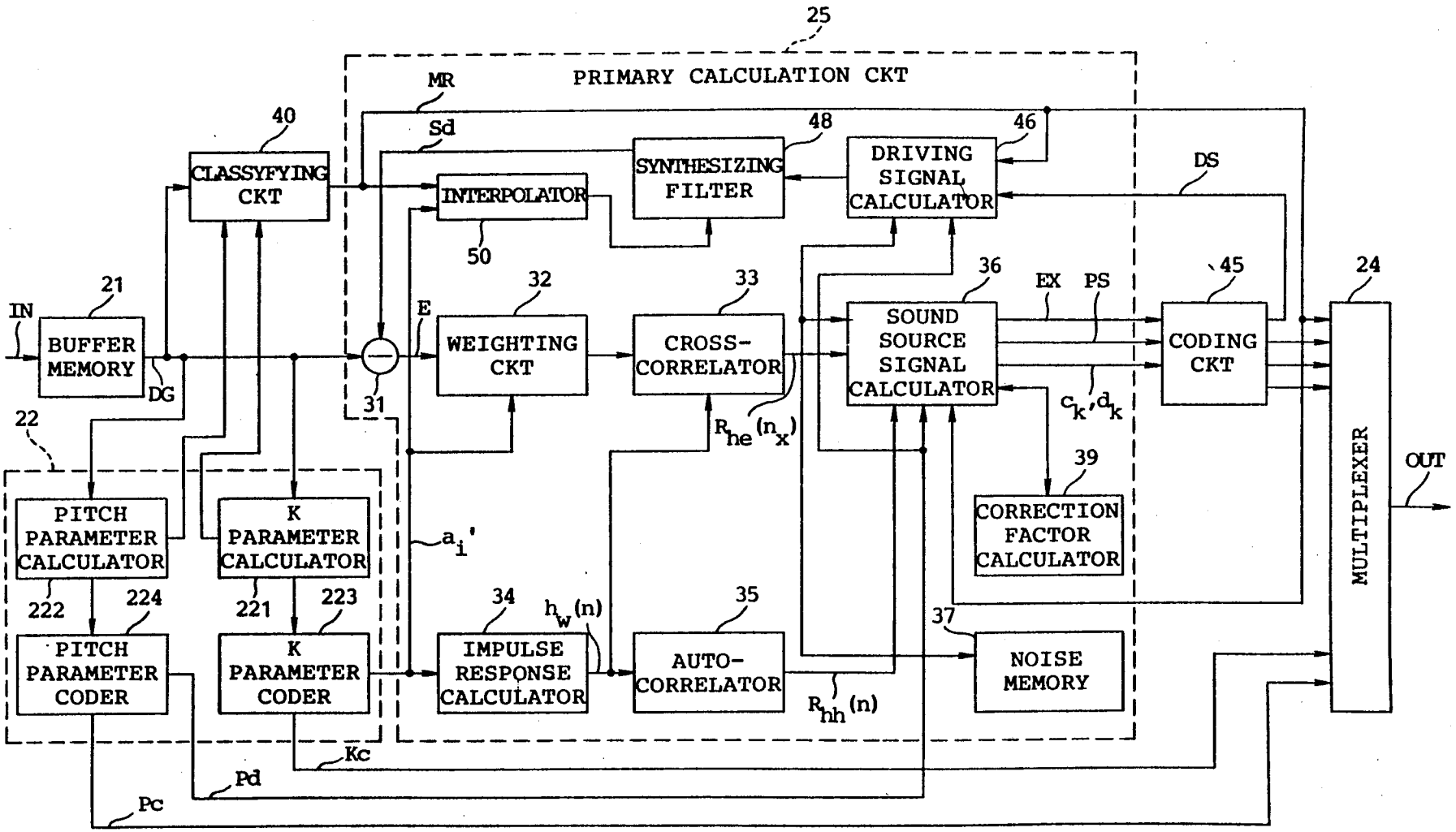
FIG. 1 is a block diagram of an encoder device according to a first embodiment of this invention.

Referring to FIG. 1, an encoder device according to a first embodiment of this invention is supplied with a sequence of system input speech signals IN to produce a sequence of output signals OUT. The system input signal sequence IN is divisible into a plurality of frames and is assumed to be sent from an external device, such as an analog-to-digital converter (not shown) to the encoder device. The system input signal sequence IN carries voiced and voiceless sounds which last for voiced and voiceless durations, respectively. Each frame may have an interval of, for example, 20 milliseconds. The system input speech signals IN are stored in a buffer memory 21 at every frame and thereafter delivered as a sequence of digital speech signals DG to a parameter calculation circuit 22 at every frame. The illustrated parameter calculation circuit 22 comprises a K parameter calculator 221 and a pitch parameter calculator 222, both of which are given the digital speech signals DG in parallel to calculate K parameters and a pitch parameter in a known manner. The K parameters and the pitch parameter will be referred to as first and second primary parameters, respectively.

Specifically, the K parameters represent a spectrum envelope of the digital speech signals at every frame and may be collectively called a spectrum parameter. The K parameter calculator 221 analyzes the digital speech signals by the use of the linear prediction coding technique known in the art to calculate only first through M-th orders of K parameters. Calculation of the K parameters are described in detail in the first and the second references which are referenced in the background of the instant specification. The K parameters are identical to PARCOR coefficients. At any rate, the K parameters calculated in the K parameter calculator 221 are sent to a K parameter coder 223 and are quantized and coded into coded K parameters Kc, each of which is composed of a predetermined number of bits. The coded K parameters Kc are delivered to a multiplexer 24. Furthermore, the coded K parameters Kc are decoded within the K parameter calculator 221 into decoded K parameters and are converted into linear prediction coefficients $a_i'(i=1\sim M)$. The linear prediction coefficients $a_i'$ are supplied to a primary calculation circuit 25 in a manner to be described later in detail. The coded K parameters and the linear prediction coefficients $a_i'$ come from the K parameters calculated by the K parameter calculator 221 and are produced in the form of electric signals which may be collectively called a first parameter signal.

In the parameter calculator 22, the pitch parameter calculator 222 calculates an average pitch period from the digital speech signals to produce as the pitch parameter, the average pitch period at every frame by a correlation method which is also described in the first and the second references and which therefore will not be mentioned hereinunder. Alternatively, the pitch parameter may be calculated by the other known methods, such as a cepstrum method, a SIFT method, a modified correlation method. In any event, the average pitch period thus calculated is coded by a pitch coder 224 into a coded pitch parameter Pc of a preselected number of bits. The coded pitch parameter Pc is sent as an electric signal. In addition, the pitch parameter is also decoded by the pitch parameter coder 224 into a decoded pitch parameter Pd which is produced in the form of an electric signal. At any rate, the coded and the decoded pitch parameters Pc and Pd are sent to the multiplexer 24 and the primary calculation circuit 25 as a second primary parameter signal representative of the average pitch period.

In the example being illustrated, the primary calculation circuit 25 is supplied with the digital speech signals DG at every frame along with the linear prediction coefficients $a_i'$ and the decoded pitch parameter Pd to successively produce a set of calculation result signals EX, representative of sound source signals in a manner to be described later. The primary calculation circuit 25 comprises a subtracter 31 responsive to the digital speech signals DG and a sequence of local decoded speech signals Sd to produce a sequence of error signals E representative of differences between the digital and the local decoded speech signals DG and Sd. The error signals E are sent to a weighting circuit 32 which is supplied with the linear prediction coefficients $a_i'$. In the weighting circuit 32, the error signals E are weighted by weights which are determined by the linear prediction coefficients $a_i'$. Thus, the weighting circuit 32 calculates a sequence of weighted errors in a known manner for supplying the same to a cross-correlator 33.

On the other hand, the linear prediction coefficients $a_i'$ are also sent from the K parameter coder 223 to an impulse response calculator 34. Responsive to the linear prediction coefficients $a_i'$, the impulse response calculator 34 calculates, in a known manner, an impulse response $h_w(n)$ of a synthesizing filter which may be subjected to perceptual weighting and which is determined by the linear prediction coefficients $a_i'$, where n represents sampling instants of the system input speech signals IN. The impulse response $h_w(n)$ thus calculated is delivered to both a cross-correlator 33 and an autocorrelator 35.

The cross-correlator 33 is given the weighted errors Ew and the impulse response $h_w(n)$ to calculate a cross-correlation function or coefficient $R_{he}(n_x)$ for a predetermined number N of samples in a well known manner, where $n_x$ represents an integer selected between unity and N, both inclusive.

The autocorrelator 35 calculates an autocorrelation or covariance function or coefficient $R_{hh}(n)$ of the impulse response $h_w(n)$ for a predetermined delay time t. The autocorrelation function $R_{hh}(n)$ is delivered to a sound source signal calculator 36 along with the cross-correlation function $R_{he}(n_x)$. The cross-correlator 33 and the autocorrelator 35 may be similar to those described in the first and the second references and will not be described any longer.

Herein, it is to be noted that the illustrated sound source signal calculator 36 is connected to a noise memory 37 and a correction factor calculator 39 included in the primary calculation circuit 25 and also to a discriminator or a classifying circuit 40 located outside of the primary calculation circuit 25.

The classifying circuit 40 is supplied with the digital speech signals DG, the pitch parameter, and the K parameters from the buffer memory 21, the pitch parameter calculator 222, and the K parameter calculator 221, respectively.

Figure 2:
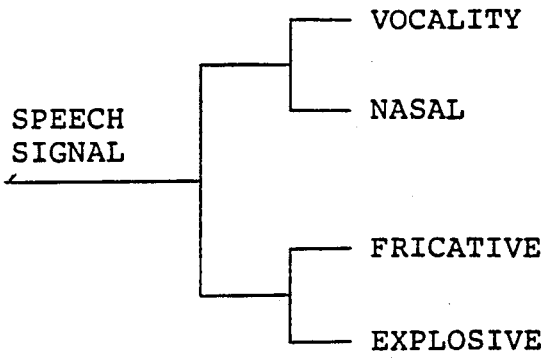
FIG. 2 is a diagram for use in describing an operation of a part of the encoder device illustrated in FIG. 1.

Briefly referring to FIG. 2 together with FIG. 1, the illustrated classifying circuit 40 is used in classifying the speech signals, namely, the digital speech signals DG, into a vowel and a consonant, which last during a vowel duration and a consonant duration, respectively. The vowel usually has periodicity while the consonant does not. Taking this into consideration, the digital speech signals are classified into periodical sounds and unperiodical sounds, in FIG. 2. Moreover, the periodical sounds are further classified into vocality and nasals while the unperiodical sounds are classified into fricatives and explosives, although the nasals have weak periodicity as compared with the vocality. In other words, a speech signal duration of the digital speech signals is divisible into a vocality duration, a nasal duration, a fricative duration, and an explosive duration.

In FIG. 1, the vocality, the nasal, the fricative, and the explosive are monitored as a subsidiary parameter in the classifying circuit 40. Specifically, the classifying circuit 40 classifies the digital speech signals into four classes specified by the vocality, the nasal, the fricative, and the explosive and judges the class to which each of the digital speech signals belongs. As a result, the classifying circuit 40 produces a monitoring result signal MR representative of a result of monitoring the subsidiary parameter. This shows that the monitoring result signal MR represents one of the selected vocality, the nasal, the fricative, or the explosive durations and lasts for the selected duration. For this purpose, the classifying circuit 40 detects power or a root means square (rms) value of the power of the digital speech signals DG, a variation of the power at every short time of, for example, 5 milliseconds, a rate of variation of the power, and a variation or a rate of the variation of a spectrum occurring for a short time, and a pitch gain which can be calculated from the pitch parameter. For example, the classifying circuit 40 detects the power or the rms of the digital speech signals to determine either the vowel duration or the consonant duration.

On detection of the vowel, the classifying circuit 40 detects either the vocality or the nasal. In this event, the monitoring result signal MR represents either the vocality or the nasal. Herein, it is possible to discriminate the nasal duration from the vocality duration by using the power or the rms, the pitch gain, and a first order log area ratio $r_1$ of the K parameter which is given by:

$$r_1 = 20\log[(1-K_1)/(1+K_1)],$$

where $K_1$ is representative of a first order K parameter. Specifically, the classifying circuit 40 discriminates the vocality when the power or the rms exceeds a first predetermined threshold level and when the pitch gain exceeds a second predetermined threshold level. Otherwise, the classifying circuit 40 discriminates the nasal.

On detection of the consonant, the classifying circuit 40 discriminates whether the consonant is fricative or explosive to determine the fricative or the explosive duration, to produce the monitoring result signal MR representative of the fricative or the explosive. Such discrimination of the fricative or the explosive is possible by monitoring the power of the digital speech signals DG at every short time of, for example, 5 milliseconds, a ratio of power between a low frequency band and a high frequency band, a variation of the rms, and the rate of the variation, as known in the art. Thus, discrimination of the vocality, the nasal, the fricative, and the explosive can be readily done by the use of a conventional method. Therefore, the classifying circuit 40 will not be described any longer.

In FIG. 1, the monitoring result signal MR represents the selected one of the vocality, the nasal, the fricative, and the explosive and is sent to the sound source signal calculator 36 together with the cross-correlation coefficient $R_{he}(n_x)$, the autocorrelation coefficient $R_{hh}(n)$, and the decoded pitch parameter Pd. In addition, the sound source signal calculator 36 is operable in combination with the noise memory 37 and the correction factor calculator 39 in a manner to be described later.

Figure 3:
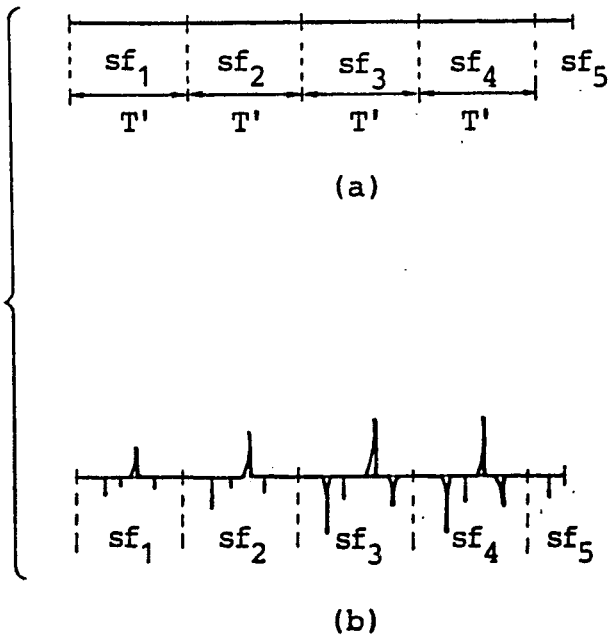
FIG. 3 is a time chart for use in describing an operation of another part of the encoder device illustrated in FIG. 1.

Referring to FIG. 3 in addition to FIG. 1, first the sound source signal calculator 36 divides a single one of the frames into a predetermined number of subframes or pitch periods each of which is shorter than each frame, as illustrated in FIG. 3(*a*), when the monitoring result signal MR is representative of the vocality. The average pitch period is calculated in the sound source signal calculator 36 in a known manner and is depicted at T' in FIG. 3(*a*). In FIG. 3(*a*), the illustrated frame is divided into first through fourth subframes $sf_1$ to $sf_4$ and the remaining duration $sf_5$. Subsequently, one of the subframes is selected as a representative subframe or duration in the sound source signal calculator 36 by a method of searching for the representative subframe.

Specifically, the sound source signal calculator 36 calculates a preselected number L of excitation pulses at every subframe, as illustrated in FIG. 3(*b*). The preselected number L is equal to four in FIG. 3(*b*). Such calculation of the excitation pulses can be carried out by the use of the cross-correlation coefficient $R_{he}(n_x)$ and the autocorrelation coefficient $R_{hh}(n)$ in accordance with methods described in the first and the second references and in a paper contributed by Araseki, Ozawa, and Ochiai to GLOBECOM 83, IEEE Global Telecommunications Conference, No. 23.3, 1983 and entitled "Multi-pulse Excited Speech Coder Based on Maximum Cross-correlation Search Algorithm". The paper will be referred to as a third reference hereinafter. Each of the excitation pulses is specified by an amplitude $g_i$ and a location $m_i$ where i represents an integer between unity and L, both inclusive. For brevity of description, let the second subframe $sf_2$ be selected as a tentative representative subframe and the excitation pulses, L in number, be calculated for the tentative representative subframe. In this event, the correction factor calculator 39 calculates an amplitude correction factor $c_k$ and a phase correction factor $d_k$ as to the other subframes $sf_1$, $sf_3$, $sf_4$, and $sf_5$, except the tentative representative subframe $sf_2$, where k is 1, 3, 4, or 5 in FIG. 3. At least one of the amplitude and the phase correction factors $c_k$ and $d_k$ may be calculated by the correction factor calculator 39, instead of calculations of both the amplitude and the phase correction factors $c_k$ and $d_k$. Calculations of the amplitude and the phase correction factors $c_k$ and $d_k$ can be executed in a known manner and will not be described any longer.

The illustrated sound source signal calculator 36 is supplied with both the amplitude and the phase correction factors $c_k$ and $d_k$ to form a tentative synthesizing filter within the sound source signal calculator 36. Thereafter, synthesized speech signals $x_k(n)$ are synthesized in the other subframes $sf_k$, respectively, by the use of the amplitude and the phase correction factors $c_k$ and $d_k$ and the excitation pulses calculated in relation to the tentative representative subframe. Furthermore, the sound source signal calculator 36 continues processing to minimize weighted error power $E_k$ with reference to the synthesized speech signals $x_k(n)$ of the other subframes $sk_k$. The weighted error power $E_k$ is given by:

$$E_k = \sum_n ([x_k(n) - \dot{x}_k(n)]*w(n))^2, \quad (1)$$

$$\text{where } x_k(n) = c_k \sum_i g_i \cdot h(n - m_i - T' - d_k) \quad (2)$$

and where w(n) is representative of an impulse response of a perceptual weighting filter; * is representative of convolution; and h(n) is representative of an impulse response of the tentative synthesizing filter. The perceptual weighting filter may not be always used on calculation of Equation (1). From Equation (1), minimum values of the amplitude and the phase correction factors $c_k$ and $d_k$ are calculated in the sound source signal calculator 36. A partial differentiation of Equation (1) is carried out with respect to $c_k$ with $d_k$ fixed to render a result of the partial differentiation into zero. Under the circumstances, the amplitude correction factor $c_k$ is given by:

$$c_k = \left(\left(\sum_n x_{wk}(n)x_{wk}(n)\right)\Big/\left(\left(\sum_n x'_{wk}(n)x_{wk}(n)\right)\right), \tag{3}$$

$$\text{where } x_{wk} = x_k(n)*w(n) \tag{4a}$$

$$\text{and } x_{wk} = \sum_i g_i \cdot h_i(n - m_i - T - d_k)*w(n). \tag{4b}$$

Thereafter, the illustrated sound source signal calculator 36 calculates values of $c_k$ for various kinds of $d_k$ by the use of Equation (3) to search for a specific combination of $d_k$ and $c_k$ which minimizes Equation (3). Such a specific combination of $d_k$ and $c_k$ makes it possible to minimize a value of Equation (1). Similar operation is carried out in connection with all of the subframes except the tentative representative subframe $sf_2$ to successively calculate combinations of $c_k$ and $d_k$ and to obtain the weighted error power E given by:

$$E = \sum_k^N E_k, \tag{5}$$

where N is representative of the number of the subframes included in the frame in question. Herein, it is noted that weighted error power $E_2$ in the second subframe, namely, in the tentative representative subframe $sf_2$, is calculated by:

$$E_2 = \sum_n \left(\left[x(n) - \sum_i g_i \cdot h(n - m_i)\right]*w(n)\right)^2. \tag{6}$$

Thus, a succession of calculations is completed for the second subframe $sf_2$ to obtain the weighted error electric power E.

Subsequently, the third subframe $sf_3$ is selected as the tentative representative subframe. Similar calculations are repeated for the third subframe $sf_3$ by the use of Equations (1) through (6) to obtain the weighted error power E. Thus, the weighted error power E is successively calculated with each of the subframes selected as the tentative representative subframe. The sound source signal calculator 36 selects minimum weighted error power determined for a selected one of the subframes $sf_1$ through $sf_4$, which is finally selected as the representative subframe. The excitation pulses of the representative subframe are produced in addition to the amplitude and the phase correction factors $c_k$ and $d_k$ calculated from the remaining subframes. As a result, sound source signals v(n) of each frame are represented by a combination of the above-mentioned excitation pulses and the amplitude and the phase correction factors $c_k$ and $d_k$ for the vocality duration and may be called a first set of primary sound source signals. In this event, the sound source signals $v_k(n)$ are given during the subframes depicted at $sf_k$ by:

$$v_k(n) = c_k \Sigma g_i \cdot \delta(n - m_i - T - d_k). \tag{7}$$

Herein, let the sound source signal calculator 36 be supplied with the monitoring result signal MR representative of the nasal. In this case, the illustrated sound source signal calculator 36 represents the sound source signals by pitch prediction multi-pulses and multi-pulses for a single frame. Such pitch prediction multi-pulses can be produced by the use of a method described in Japanese Unexamined Patent Publication No. Syô 59-13, namely, 13/1984 (to be referred to as a fourth reference), while the multi-pulses can be calculated by the use of the method described in the third reference. The pitch prediction multi-pulses and the multi-pulses are calculated over a whole frame during which the nasal is detected by the classifying circuit 40 and may be called excitation pulses.

Furthermore, it is assumed that the classifying circuit 40 detects either the fricative or the explosive to produce the monitoring result signal MR representative of either the fricative or the explosive. Specifically, let the fricative be specified by the monitoring result signal MR. In this event, the illustrated sound source signal calculator 36 cooperates with the noise memory 37 which memorizes indices and gains representative of species of noise signals. The indices and the gains may be tabulated in the form of code books, as mentioned in the first and the second references.

Under the circumstances, the sound source signal calculator 36 at first divides a single frame in question into a plurality of subframes, like in the vocality duration, on detection of the fricative. Subsequently, processing is carried out at every subframe in the sound source signal calculator 36 to calculate the predetermined number L of multi-pulses or excitation pulses and to thereafter read a combination selected from combinations of the indices and the gains out of the noise memory 37. As a result, the amplitudes and the locations of the excitation pulses are produced as sound source signals by the sound source signal calculator 36 together with the index and the gain of the noise signal which are sent from the noise memory 37.

In addition, let the explosive be detected by the classifying circuit 40 and the monitoring result signal MR be representative of the explosive. In this event, the sound source signal calculator 36 searches for excitation pulses of a number determined for a whole single frame and calculates amplitudes and locations of the excitation pulses over the whole single frame. The amplitudes and the locations of the excitation pulses are produced as sound source signals like in the fricative duration.

Thus, the illustrated sound source signal calculator 36 produces, during the nasal, the fricative, and the explosive, the sound source signals EX which are different from the primary sound source signals and which may be called a second set of secondary sound source signals.

In any event, the primary and the secondary sound source signals are delivered as the calculation result signal EX to a coding circuit 45 and coded into a set of coded signals. More particularly, the coding circuit 45 is supplied during the vocality with the amplitudes $g_i$ and the locations $m_i$ of the excitation pulses derived from the representative duration as a part of the primary sound source signals. The amplitude correction factor $c_k$ and the phase correction factor $d_k$ are also supplied as another part of the primary sound source signals to the coding circuit 45. In addition, the coding circuit 45 is supplied with a subframe position signal ps representative of a position of the representative subframe. The amplitudes $g_i$, the locations $m_i$, the subframe position signal ps, the amplitude correction factor $c_k$, and the phase correction factor $d_k$ are coded by the coding circuit 45 into a set of coded signals. The coded signal set is composed of coded amplitudes, coded locations, a coded subframe position signal, a coded amplitude correction factor, and a coded phase correction factor, all of which are represented by preselected numbers of bits, respectively, and which are sent to the multiplexer 24 to be produced as the output signal sequence OUT.

Furthermore, the coded amplitudes, the coded locations, the coded subframe position signal, the coded amplitude correction factor, and the coded phase correction factor are decoded by the coding circuit 45 into a sequence of decoded sound source signals DS.

During the nasal, the fricative, and the explosive, the coding circuit 45 codes amplitudes and locations of the multi-pulses, namely, the excitation pulses into the coded signal set on one hand, and decodes the excitation pulses into the decoded sound source signal sequence DS on the other hand. In addition, the gain and the index of each noise signal are coded into a sequence of coded noise signals during the fricative duration by the coding circuit 45 as the decoded sound source signals DS.

The illustrated sound source signal calculator 36 can be implemented by a microprocessor which executes a software program. Inasmuch as each operation itself executed by the calculator 36 is individually known in the art, it is readily possible for those skilled in the art to form such a software program for the illustrated sound source signal calculator 36.

The decoded sound source signals DS and the monitoring result signal MR are supplied with a driving signal calculator 46. In addition, the driving signal calculator 46 is connected to both the noise memory 37 and the pitch parameter coder 224. In this connection, the driving signal calculator 46 is also supplied with the decoded pitch parameter Pd representative of the average pitch period T' while the driving signal calculator 46 selectively accesses the noise memory 37 during the fricative to extract the gain and the index of each noise signal therefrom, like the sound source signal calculator 36.

For the vocality duration, the driving signal calculator 46 divides each frame into a plurality of subframes by the use of the average pitch period T', like the excitation pulse calculator 45 and reproduces a plurality of excitation pulses within the representative subframe by the use of the subframe position signal ps and the decoded amplitudes and locations carried by the decoded sound source signals DS. The excitation pulses reproduced during the representative subframe may be referred to as representative excitation pulses. During the remaining subframes, excitation pulses are reproduced into the sound source signals v(n) given by Equation (7) by using the representative excitation pulses and the decoded amplitude and phase correction factors carried by the decoded sound source signals DS.

During the nasal, the fricative, and the explosive, the driving signal calculator 46 generates a plurality of excitation pulses in response to the decoded sound source signals DS. In addition, the driving signal calculator 46 reproduces a noise signal during the fricative by accessing the noise memory 37 by the index of the noise signal and by multiplying a noise read out of the noise memory 37 by the gain. Such a reproduction of the noise signal during the fricative is disclosed in the second reference and will therefore not be described any longer. The excitation pulses and the noise signal are produced as a sequence of driving sound signals.

Thus, the driving source signals reproduced by the driving signal calculator 46 are delivered to a synthesizing filter 48. The synthesizing filter 48 is coupled to the K parameter coder 223 through an interpolator 50. The interpolator 50 converts the linear prediction coefficients $a_i'$ into K parameters and interpolates K parameters at every subframe having the average pitch period T' to produce interpolated K parameters. The interpolated K parameters are inversely converted into linear prediction coefficients which are sent to the synthesizing filter 48. Such interpolation may also be made for known parameters, such as log area ratios, except the K parameters. It is to be noted that no interpolation is carried out during the nasal and the consonant, such as the fricative and the explosive. Thus, the interpolator 50 supplies the synthesizing filter 48 with the linear prediction coefficients converted by the interpolator 50 during the vocality, as mentioned before.

Supplied with the driving source signals and the linear prediction coefficients, the synthesizing filter 48 produces a synthesized speech signal for a single frame and an influence signal for the single frame. The influence signal is indicative of an influence exerted on the following frame and may be produced in a known manner described in Unexamined Japanese patent application No. Syô 59-116794, namely, 116794/1984 which may be called a fifth reference. A combination of the synthesized speech signal and the influence signal is sent to the subtracter 31 as the local decoded speech signal sequence Sd.

In the example being illustrated, the multiplexer 24 is connected to the classifying circuit 40, the coding circuit 45, the pitch parameter coder 224, and the K parameter coder 223. Therefore, the multiplexer 24 produces codes which specify the above-mentioned sound sources and the monitoring result signal MR representative of the species of each speech signal. In this event, the codes for the sound sources and the monitoring result signal may be referred to as sound source codes and second species codes, respectively. The sound source codes include an amplitude correction factor code and a phase correction factor code together with excitation pulse codes when the vocality is indicated by the monitoring result signal MR. In addition, the multiplexer 45 produces codes which are representative of the subframe position signal, the average pitch period, and the K parameters and which may be called position codes, pitch codes, and K parameter codes, respectively. All of the above-mentioned codes are transmitted as the output signal sequences OUT. In this connection, a combination of the coding circuit 45 and the multiplexer 24 may be referred to as an output circuit for producing the output signal sequence OUT.

Figure 4:
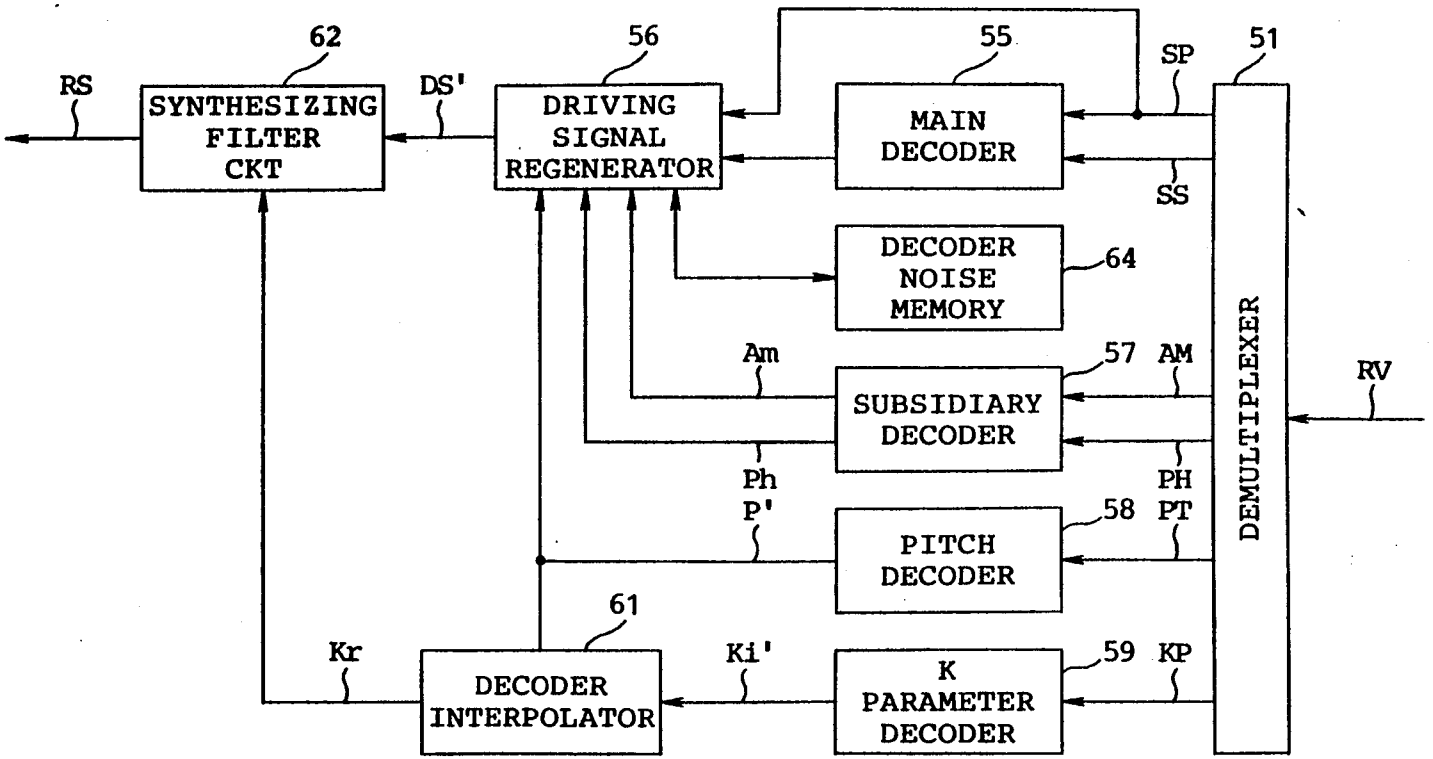
FIG. 4 is a block diagram of a decoder device which is communicable with the encoder device illustrated in FIG. 1 to form a communication system along with the encoder device.

Referring to FIG. 4, a decoding device is communicable with the encoding device illustrated in FIG. 1 and is supplied as a sequence of reception signals RV with the output signal sequence OUT shown in FIG. 1. The reception signals RV are given to a demultiplexer 51 and demultiplexed into the sound source codes, the sound species codes, the pitch codes, the position codes, and the K parameter codes which are all transmitted from the encoding device illustrated in FIG. 1 and which are depicted at SS, SP, PT, PO, and KP, respectively. The sound source codes SS include the first set of the primary sound source signals and the second set of the secondary sound source signals. The primary sound source signals carry the amplitude and the phase correction factors $c_k$ and $d_k$ which are given as amplitude and phase correction factor codes AM and PH, respectively.

The sound source codes SS and the species codes SP are sent to a main decoder 55. Supplied with the sound source codes SS and the species codes SP, the main decoder 55 reproduces excitation pulses from amplitudes and locations carried by the sound source codes SS. Such a reproduction of the excitation pulses is carried out during the representative subframe when the specifies codes SP represent the vocality. Otherwise, a reproduction of excitation pulses lasts for an entire frame.

In the illustrated example, the species codes SP are also sent to a driving signal regenerator 56. The amplitude and the phase correction factor codes AM and PH are sent as a subsidiary information code to a subsidiary decoder 57 to be decoded into decoded amplitude and phase correction factors Am and Ph, respectively, while the pitch codes PT and the K parameter codes KP are delivered to a pitch decoder 58 and a K parameter decoder 59, respectively, and decoded into decoded pitch parameters P' and decoded K parameters Ki', respectively. The decoded K parameters Ki' are supplied to a decoder interpolator 61 along with the decoded pitch parameters P', respectively. The decoder interpolator 61 is operable in a manner similar to the interpolator 50 illustrated in FIG. 1 and interpolates a sequence of K parameters over a whole of a single frame from the decoded K parameters Ki' to supply interpolated K parameters Kr to a reproduction synthesizing filter 62. On the other hand, the amplitude and the phase correction factor codes AM and PH are decoded by the subsidiary decoder 57 into decoded amplitude and phase correction factors Am and Ph, respectively, which are sent to the driving signal regenerator 56.

A combination of the main decoder 55, the driving signal regenerator 56, the subsidiary decoder 57, the pitch decoder 58, the K parameter decoder 59, the decoder interpolator 61, and the decoder noise memory 64 may be referred to as a reproducing circuit for producing a sequence of driving sound source signals.

Responsive to the decoded amplitude and phase correction factors Am and Ph, the decoded pitch parameters P', the species codes SP, and the excitation pulses, the excitation pulse regenerator 56 regenerates a sequence of driving sound source signals DS' for each frame. In this event, the driving sound source signals DS' are regenerated in response to the excitation pulses produced during the representative subframe, when the species codes SP is representative of the vocality. The decoded amplitude and phase correction factors Am and Ph are used to regenerate the driving sound source signals DS' within the remaining subframes. In addition, the preselected number of the driving sound source signals DS' are regenerated for an entire frame when the species codes SP represent the nasal, the fricative, and the explosive. Moreover, when the fricative is indicated by the species codes SP, the excitation pulse regenerator 56 accesses the decoder noise memory 64 which is similar to that illustrated in FIG. 1. As a result, an index and a gain of a noise signal are read out of the decoder noise memory to be sent to the excitation pulse regenerator 56 together with the excitation pulses for an entire frame.

The driving sound source signals DS' are sent to the synthesizing filter circuit 62 along with the interpolated K parameters Kr. The synthesizing filter circuit 62 is operable in a manner described in the fifth reference to produce, at every frame, a sequence of synthesized speech signals RS which may be depicted at x(n).

Figure 5:
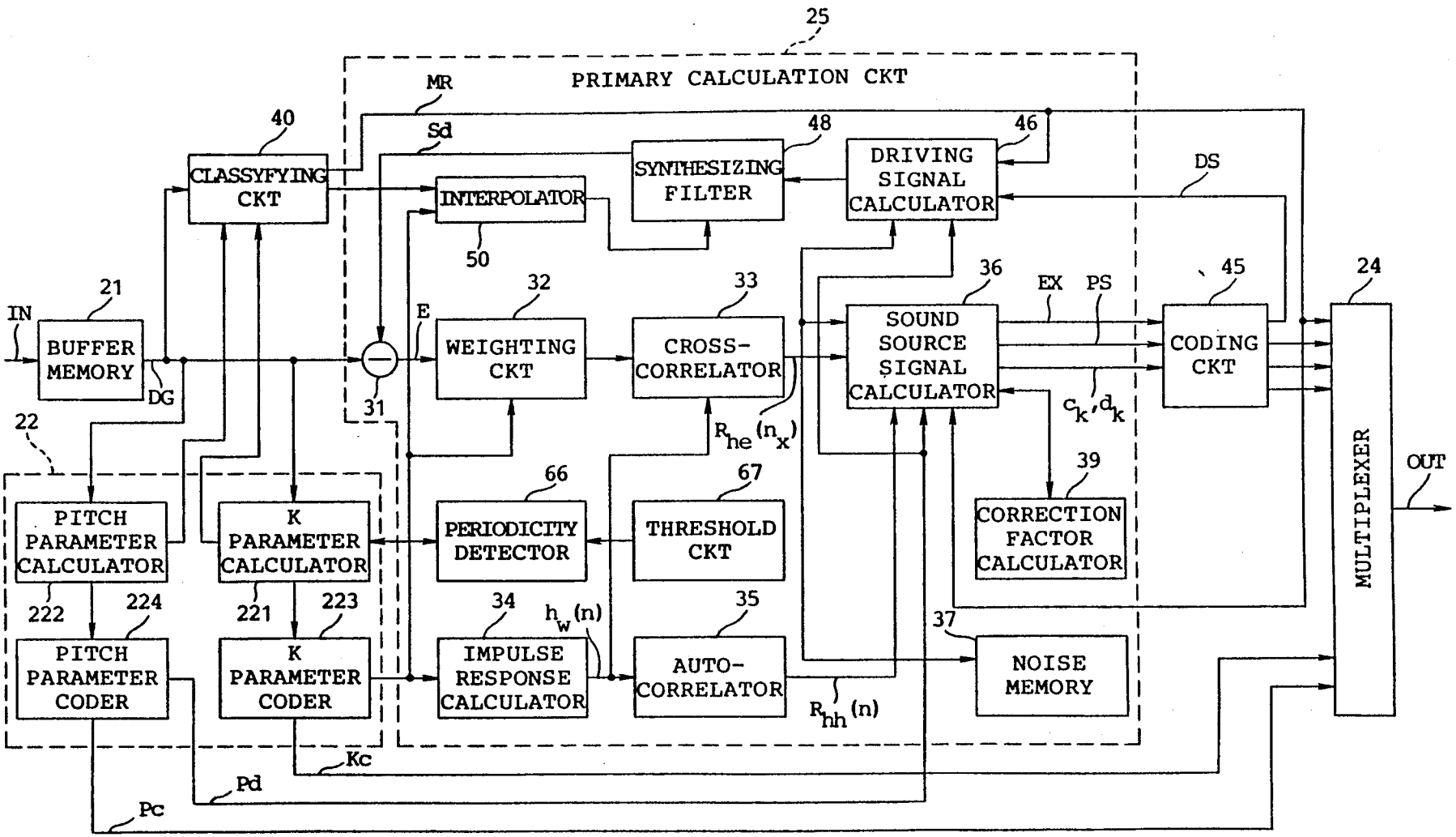
FIG. 5 is a block diagram of an encoder device according to a second embodiment of this invention.

Referring to FIG. 5, an encoding device according to a second embodiment of this invention is similar in structure and operation to that illustrated in FIG. 1, except that the primary calculation circuit 25 shown in FIG. 5 comprises a periodicity detector 66 and a threshold circuit 67 connected to the periodicity detector 66. The periodicity detector 66 is operable in cooperation with a spectrum calculator, namely, the K parameter calculator 221 to detect periodicity of a spectrum parameter which is exemplified by the K parameters. The periodicity detector 66 converts the K parameters into linear prediction coefficients $a_i$ and forms a synthesizing filter by the use of the linear prediction coefficients $a_i$, as already suggested earlier in the specification. Herein, it is assumed that such a synthesizing filter is formed in the periodicity detector 66 by the linear prediction coefficients $a_i$ obtained from the K parameters analyzed in the K parameter calculator 221. In this case, the synthesizing filter has a transfer function H(z) given by:

$$H(z) = 1/\left(1 - \sum_{i}^{p} a_i z^{-1}\right), \tag{8}$$

where $a_i$ is representative of the spectrum parameter and p, an order of the synthesized filter. Thereafter, the periodicity detector 66 calculates an impulse response h(n) of the synthesized filter is given by:

$$h(n) = \sum_{i}^{p} a_i h(n-i) + G\delta(n), \ (n \geqq 0), \tag{9}$$

where G is representative of an amplitude of an excitation source.

As known in the art, it is possible to calculate a pitch gain Pg from the impulse response h(n). Under the circumstances, the periodicity detector 66 further calculates the pitch gain Pg from the impulse response h(n) of the synthesizing filter formed in the above-mentioned manner and thereafter compares the pitch gain Pg with a threshold level supplied from the threshold circuit 67.

Practically, the pitch gain Pg can be obtained by calculating an autocorrelation function of h(n) for a predetermined delay time and by selecting a maximum value of the autocorrelation function that appears at a certain delay time. Such calculation of the pitch gain can be carried out in a manner described in the first and the second references and will not be mentioned hereinafter.

Inasmuch as the pitch gain Pg tends to increase as the periodicity becomes strong in the impulse response, the illustrated periodicity detector 66 detects that the periodicity of the impulse response in question is strong when the pitch gain Pg is higher than the threshold level. On detection of strong periodicity of the impulse response, the periodicity detector 66 weights the linear prediction coefficients $a_i$ by modifying $a_i$ into weighted coefficients $a_w$ given by:

$$a_w = a_i \cdot r^i \ (1 \leqq i \leqq p), \tag{10}$$

where r is representative of a weighting factor and is a positive number smaller than unity.

It is to be noted that a frequency bandwidth of the synthesizing filter depends on the above-mentioned weighted coefficients $a_w$, especially, the value of the weighting factor r. Taking this into consideration, the frequency bandwidth of the synthesizing filter becomes wide with an increase of the value r. Specifically, an increased bandwidth B (Hz) of the synthesizing filter is given by:

$$B = Fs/\pi \cdot ln(r) \ (Hz). \tag{11}$$

Practically, when r and Fs of Equation (11) are equal to 0.98 and 8 kHz, respectively, the increased bandwidth B is about 50 Hz.

From this fact, it is readily understood that the periodicity detector 66 inversely converts the weighted coefficients $a_w$ into weighted K parameters, when the pitch gain Pg is higher than the threshold level. As a result, the K parameter calculator 221 produces the weighted K parameters. On the other hand, when the pitch gain Pg is not higher than the weighting factor r, the periodicity detector 66 inversely converts the linear prediction coefficients into unweighted K parameters.

Inverse conversion of the linear prediction coefficients into the weighted K parameters or the unweighted K parameters can be done by the use of a method described by J. Makhoul et al in "Linear Prediction of Speech".

Thus, the periodicity detector 66 illustrated in the encoding device detects the pitch gain from the impulse response to supply the K parameter calculator 221 with the weighted or the unweighted K parameters encoded by the K parameter coder 223. With this structure, the frequency bandwidth is widened in the synthesizing filter when the periodicity of the impulse response is strong and when the pitch gain increases. Therefore, it is possible to prevent a frequency bandwidth from unfavorably becoming narrow for the first order formant. This shows that the interpolation of the excitation pulses can be favorably carried out in the primary calculation circuit 25 by the use of the excitation pulses derived from the representative subframe.

In the periodicity detector 66, the periodicity of the impulse response may be detected only for the vowel duration. The periodicity detector 66 can be implemented by a software program executed by a microprocessor like the sound source signal calculator 36 and the driving signal calculator 46 illustrated in FIG. 1. Thus, the periodicity detector 66 monitors the periodicity of the impulse response as a subsidiary parameter in addition to the vocality, the nasal, the fricative, and the explosive and may be called a discriminator for discriminating the periodicity.

Figure 6:
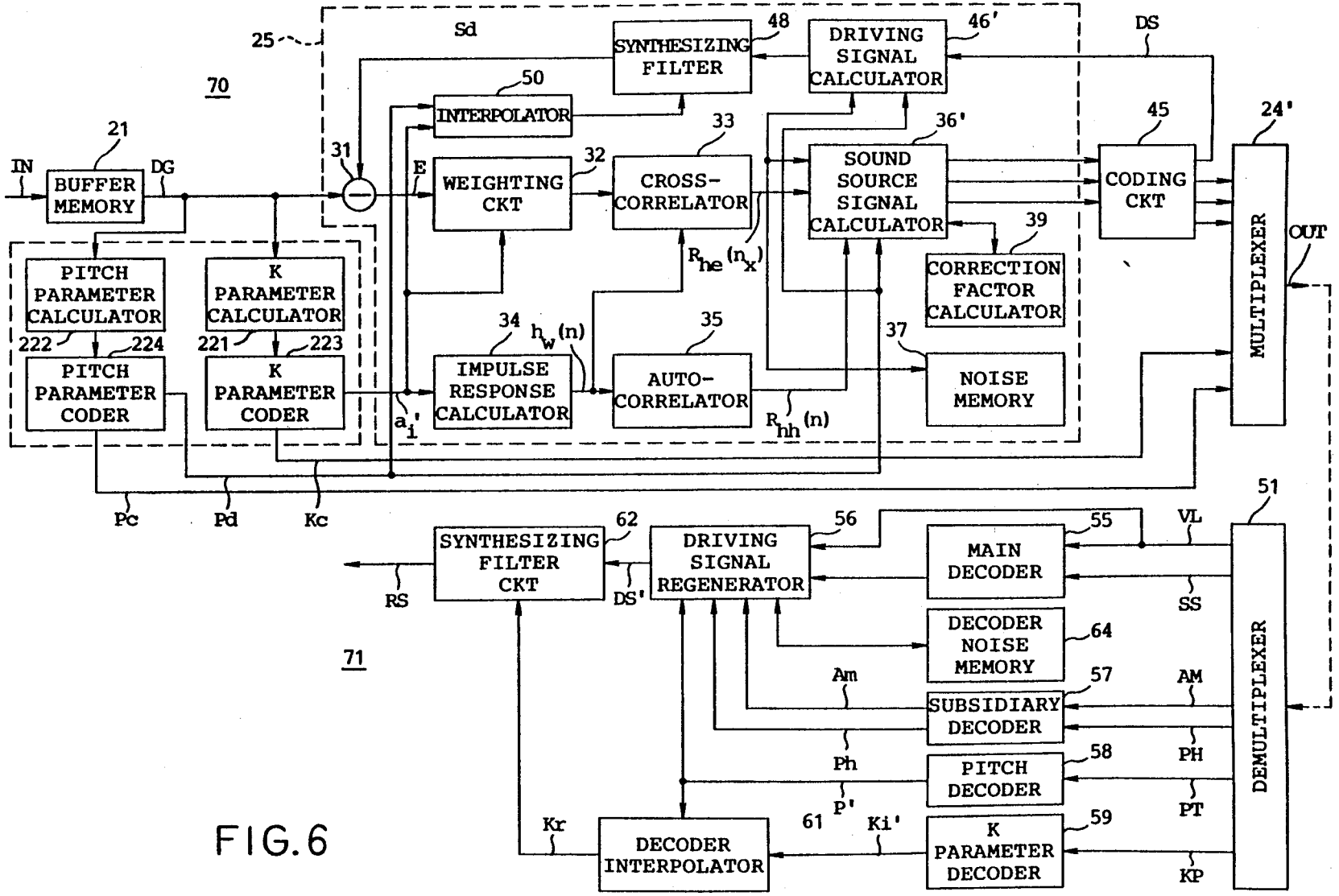
FIG. 6 is a block diagram of a communication system according to a third embodiment of this invention.

Referring to FIG. 6, a communication system according to a third embodiment of this invention comprises an encoding device 70 and a decoding device 71 communicable with the encoding device 70. In the example being illustrated, the encoder device 70 is similar in structure to that illustrated in FIG. 1 except that the classifying circuit 40 illustrated in FIG. 1 is removed from FIG. 6. Therefore, the monitoring result signal MR (shown in FIG. 1) is not supplied to a sound source signal calculator, a driving signal calculator, and a multiplexer which are therefore depicted at 36', 46', and 24', respectively.

In this connection, the sound source signal calculator 36' is operable in response to the cross-correlation coefficient $R_{he}(n)$, the autocorrelation coefficient $R_{hh}(n)$, and the decoded pitch parameter Pd and is connected to the noise memory 37 and the correction factor calculator 39 like in FIG. 1 while the driving signal calculator 46' is supplied with the decoded sound source signals DS and the decoded pitch parameter Pd and is connected to the noise memory 37 like in FIG. 1.

Like the sound source signal calculator 36 and the driving signal calculator 46 illustrated in FIG. 1, each of the sound source signal calculator 36' and the driving signal calculator 46' may be implemented by a microprocessor which executes a software program so as to carry out operations in a manner to be described below. Inasmuch as the other structural elements may be similar in operation and structure to those illustrated in FIG. 1, respectively, description will be mainly directed to the sound source signal calculator 36' and the driving signal calculator 46'.

Now, the sound source signal calculator 36' calculates a pitch gain Pg in a known manner to compare the pitch gain with a threshold level Th and to determine either a voiced sound or an unvoiced (voiceless) sound. Specifically, when the pitch gain Pg is higher than the threshold level TH, the sound source signal calculator 36' judges a speech signal as the voiced sound. Otherwise, the sound source signal calculator 36' judges the speech signal as the voiceless sound.

During the voiced sound, the sound source signal calculator 36' first divides a single frame into a plurality of the subframes by the use of the average pitch period T' specified by the decoded pitch parameter Pd. The sound source signal calculator 36' calculates a predetermined number of the excitation pulses as sound source signals during the representative subframe in the manner described in conjunction with FIG. 1 and thereafter calculates amplitudes and locations of the excitation pulses. In the remaining subframes (depicted at k) except the representative subframe, the correction factor calculator 39 is accessed by the sound source signal calculator 36' to calculate the amplitude and the phase correction factors $c_k$ and $d_k$ in the manner described in conjunction with FIG. 1. Calculation of the amplitude and the phase correction factors $c_k$ and $d_k$ has been already described with reference to FIG. 1 and will therefore not be mentioned any longer. The amplitudes and the locations of the excitation pulses and the amplitude and the phase correction factors $c_k$ and $d_k$ are produced as the primary sound source signals.

During the voiceless sound, the sound source signal calculator 36' calculates a preselected number of multipulses or excitation pulses and a noise signal as the secondary sound source signals. For this purpose, the sound source signal calculator 36' accesses the noise memory 37 which memorizes a plurality of noise signals to calculate indices and gains. Such calculations of the excitation pulses and the indices and the gains of the noise signals are carried out at every subframe in a manner described in the second reference. Thus, the sound source signal calculator 36' produces amplitudes and locations of the excitation pulses and the indices and the gains of the noise signals at every one of the subframes except the representative subframe.

During the voiced sound, the coding circuit 45 codes the amplitude $g_i$ and the locations $m_i$ of the excitation pulses extracted from the representative subframe into coded amplitudes and locations, each of which is represented by a prescribed number of bits. In addition, the coding circuit 45 also codes a position signal indicative of the representative subframe and the amplitude and the phase correction factors into a coded position signal and coded amplitude and phase correction factors. During the voiceless sound, the coding circuit 45 codes the indices and the gains together with the amplitudes and the locations of the excitation pulses. Moreover, the above-mentioned coded signals, such as the code amplitudes and the coded locations, are decoded within the coding circuit 45 into a sequence of decoded sound source signals DS, as mentioned in conjunction with FIG. 1.

The decoded sound source signals DS are delivered to the driving signal calculator 46' which is also supplied with the decoded pitch parameter Pd from the pitch parameter coder 224. During the voiced sound, the driving signal calculator 46' divides a single frame into a plurality of subframes by the use of the average pitch period specified by the decoded pitch parameter Pd and thereafter reproduces excitation pulses by the use of the position signal, the decoded amplitudes, and the decoded locations during the representative subframe. During the remaining subframes, sound source signals are reproduced in accordance with Equation (7) by the use of the reproduced excitation pulses and the decoded amplitude and phase correction factors.

On the other hand, the driving signal calculator 46' reproduces, during the voiceless sound, excitation pulses in the known manner and sound source signals which are obtained by accessing the noise memory 37 by the use of the indices to read the noise signals out of the noise memory 37 and by multiplying the noise signals by the gains. Such a reproduction of the sound source signals is shown in the second reference.

The reproduced sound source signals are calculated in the driving signal calculator 46' and sent as a sequence of driving signals to the synthesizing filter 48 during the voiced and the voiceless sounds. The synthesizing filter 48 is connected to and controlled by the interpolator 50 in the manner illustrated in FIG. 1. During the voiced sound, the interpolator 50 interpolates, at every subframe, K parameters obtained by converting linear prediction coefficients $a_i'$ given from the K parameter coder 223 and which thereafter inversely converts the K parameters into converted linear prediction coefficients. However, no interpolation is carried out in the interpolator 50 during the unvoiced sound.

Supplied with the driving signals and the converted linear prediction coefficients, the synthesizing filter 48 synthesizes a synthesized speech signal and additionally produces, for the signal frame, an influence signal which is indicative of an influence exerted on the following frame.

The illustrated multiplexer 24' produces a code combination of sound source signal codes, codes indicative of either the voiced sound or the voiceless sound, a position code indicative of a position of the representative subframe, a code indicative of the average pitch period, codes indicative of the K parameters, and codes indicative of the amplitude and the phase correction factors. Such a code combination is transmitted as a sequence of output signals OUT to the decoding device 71 illustrated in a lower portion of FIG. 6.

The decoding device 71 illustrated in FIG. 6 is similar in structure and operation to that illustrated in FIG. 4 except that a voiced/voiceless code VL is given from the demultiplexer 51 to both the main decoder 55 and the driving signal regenerator 56 instead of the sound species code SP (FIG. 4) to represent either the voiced sound or the voiceless sound. Therefore, the illustrated main decoder 55 and the driving signal regenerator 56 carry out operations in consideration of the voiced/-voiceless code VL. Thus, the main decoder 55 decodes the sound source codes SS into sound source signals during the voiced and the voiceless sounds. In addition, the driving signal regenerator 56 supplies the synthesizing filter circuit 62 with the driving sound source signals DS'. Any other operation of the decoding device 71 is similar to that illustrated in FIG. 4 and will therefore not be described.

While this invention has thus far been described in conjunction with a few embodiments thereof, it will readily be possible for those skilled in the art to put this invention into practice in various other ways. For example, the spectrum parameter may be another parameter, such as an LPS, a cepstrum, an improved cepstrum, or a generalized cepstrum, a melcepstrum. In the interpolator 50 and the decoder interpolator 61, interpolation is carried out by a technique discussed in the paper contributed by Atal et al in Journal Acoust. Cos. Am., and entitled "Speech Analysis and Synthesis by Linear Prediction of Speech Waves" (pp. 637–655). The phase correction factor $d_k$ may not always be transmitted when the decoded average pitch period T' is interpolated at every subframe. The amplitude correction factor $c_k$ may approximate each calculated amplitude correction factor by a least square curve or line and may be represented by a factor of the least square curve or line. In this event, the amplitude correction factor may not be transmitted at every subframe but intermittently transmitted. As a result, an amount of information can be reduced for transmitting the correction factors. Each frame may be continuously divided into the subframes from a previous frame or may be divided by methods disclosed in Japanese patent applications Nos. Syô 59-272435, namely, 272435/1984 and Syô 60-178911, namely, 178911/1985.

In order to considerably reduce the number of calculations, a preselected subframe may be fixedly determined in each frame as a representative subframe during the vowel or the voiced sound. For example, such a preselected subframe may be a center subframe located at a center of each frame or a subframe having maximum power within each frame. This dispenses with calculations carried out by the use of Equations (5) and (6) to search for the representative subframe, although a speech quality might be slightly degraded. In addition, the influence signal may not be calculated on the transmitting end so as to reduce the number of calculations. On the receiving end, an adaptive post filter may be located after the synthesizing filter circuit 62 so as to respond to either pitch or a spectrum envelope. The adaptive post filter is helpful for improving a perceptual characteristic by shaping a quantization noise. Such an adaptive post filter is disclosed by kroon et al in a paper entitled "A Class of Analysis-by-synthesis Predictive Coders for High Quality at Rates between 4.8 and 16 kb/s" (IEEE JSAC, vol. 6,2, pp. 353–363, 1988).

It is known in the art that the autocorrelation function and the cross-correlation function can be made to correspond to power spectrum and a cross-power spectrum which are calculated along a frequency axis, respectively. Accordingly, similar operation can be carried out by the use of the power spectrum and the cross-power spectrum. The power and the cross-power spectra can be calculated by a method disclosed by Oppenheim et al in "Digital Signal Processing" (Prentice-Hall, 1975).

What is claimed is:

1. In an encoder device supplied with a sequence of digital speech signals to produce a sequence of output signals, the sequence of said digital speech signals forming a frame, said encoder device comprising parameter calculation means responsive to said sequence of the digital speech signals for calculating first and second primary parameters which specify a spectrum envelope and a pitch of said sequence of the digital speech signals to produce first and second parameter signals representative of said spectrum envelope and said pitch, respectively, primary calculation means coupled to said parameter calculation means for calculating a set of calculation result signals representative of the sequence of said digital speech signals, and output signal producing means for successively rendering said set of the calculation result signals into the sequence of said output signals, the improvement wherein said encoder device comprises:

subsidiary parameter extracting means supplied with the sequence of said digital speech signals and said first and said second primary parameter signals for extracting, from the sequence of said digital speech signals, a subsidiary parameter which is different from said first and said second primary parameters and which specifies a selected one of at least three species of said sequence of the digital speech signals to classify the sequence of said digital speech signals into one of said at least three classes corresponding to said at least three species, respectively, and to produce a class identification signal representative of each of said sequence of said digital speech signals to produce a class identification signal representative of each of said at least three classes;

means for producing said class identification signal as a monitoring result signal representative of a result of monitoring said subsidiary parameter;

processing means supplied with said digital speech signals, said first and second primary parameter signals, and said monitoring result signal for processing said digital speech signals to selectively produce a first set of primary sound source signals and a second set of secondary sound source signals different from said first set of the primary sound source signals, said first set of the primary sound source signals being formed by a set of excitation pulses calculated with respect to a selected one of subframes which result from dividing every frame in dependency upon said second primary parameter signal and each of which is shorter than said frame and means for supplying a combination of said primary and said secondary sound source signals to said output signal producing means as said calculation result signals.

2. An encoder device as claimed in claim 1, the species of said digital speech signals being classified into vocality, nasal, fricative, and explosive, wherein said processing means selectively produces the first set of the primary sound source signals when the monitoring result signal is representative of said vocality and, otherwise, to produce the second set of the sound source signals.

3. An encoder device as claimed in Claim 1, said first parameter determining a synthesizing filter having an impulse response, wherein said subsidiary parameter extracting means extracts, as said subsidiary parameter, periodicity of said impulse response of said synthesizing filter to decide whether or not the periodicity of the impulse response is higher than a predetermined threshold level and comprises:

threshold means for producing said predetermined threshold level;

periodicity detecting means coupled to said parameter calculation means and said threshold means and supplied with said first primary parameter for detecting whether or not said periodicity of the impulse response is higher than said predetermined threshold level to produce a periodicity signal when said periodicity is higher than said predetermined threshold level; and means for supplying said periodicity signal to said parameter calculation means as said monitoring result signal to weight said first primary parameter on the basis of said periodicity signal and to make said parameter calculation means produce the first primary parameter weighted by said periodicity signal.

4. A decoder device communicable with the encoder device claimed in claim 1 to produce a sequence of synthesized speech signals, said decoder device being supplied with said output signal sequence as a sequence of reception signals which carries said first set of the primary sound source signals, said second set of the secondary sound source signals, said first and said second primary parameters, and said subsidiary parameter, said decoder device comprising:

demultiplexing means supplied with said reception signal sequence for demultiplexing said reception signal sequence into the primary and the secondary sound source signals, the first and the second primary parameters, and the subsidiary parameter as primary and secondary sound source codes, first and second parameter codes, and a subsidiary parameter code, respectively, said primary sound source codes conveying said set of the excitation pulses and said subsidiary information signal which are demultiplexed into excitation pulse codes and a subsidiary information code, respectively;

reproducing means coupled to said demultiplexing means for reproducing said primary and said secondary sound source codes into a sequence of driving sound source signals by using said subsidiary information signal, said first and said second parameter codes, and said subsidiary parameter code, and means coupled to said reproducing means for synthesizing said driving sound source signals into said synthesized speech signals.

5. A decoder device as claimed in claim 4, wherein said reproducing means comprises:

first decoding means supplied with said primary and said secondary sound source codes and said subsidiary parameter code for decoding said primary and said secondary sound source codes into primary and secondary decoded sound source signals, respectively;

second decoding means supplied with said subsidiary information code from said demultiplexing means for decoding said subsidiary information code into a decoded subsidiary code;

third decoding means supplied with said first and said second parameter codes from said demultiplexing means for decoding said first and said second parameter codes into first and second decoded parameter codes, respectively;

means coupled to said first through said third decoding means for reproducing said primary and said secondary decoded sound source signals into said driving sound source signals by the use of said decoded subsidiary code, said first and said second decoded parameter codes, and said subsidiary parameter code.

6. In an encoder device supplied with a sequence of digital speech signals to produce a sequence of output signals, the sequence of said digital speech signals forming a frame, said encoder device comprising parameter calculation means responsive to said sequence of the digital speech signals for calculating first and second primary parameters which specify a spectrum envelope and a pitch of said sequence of the digital speech signals to produce first and second parameter signals representative of said spectrum envelope and said pitch, respectively, primary calculation means coupled to said parameter calculation means for calculating a set of calculation result signals representative of the sequence of said digital speech signals, and output signal producing means for successively rendering said set of the calculation result signals into said output signals, said digital speech signals being classified as a voiced sound and a voiceless sound, the improvement wherein said primary calculation means comprises:

processing means supplied with said digital speech signals and said first and said second primary parameters for processing said digital speech signals to selectively produce a first set of primary sound source signals and a second set of secondary sound source signals during said voiced sound and said voiceless sound, respectively, said first set of the primary sound source signals being formed by a set of excitation pulses calculated with respect to a selected one of subframes which result from dividing every frame in dependency upon said second primary parameter signal and each of which is shorter than said frame; and means for applying a combination of said first and said second sets of the sound source signals to said output signal producing means as said calculation result signals.

7. A decoder device communicable with the encoder device claimed in claim 6 to produce a sequence of synthesized speech signals, said decoder device being supplied with said output signal sequence as a sequence of reception signals which carriers said first set of the primary sound source signals, said second set of the secondary sound source signals, said first and said second primary parameters, said decoder device comprising:

demultiplexing means supplied with said reception signal sequence for demultiplexing said reception signal sequence into the primary and the secondary sound source signals and the first and the second primary parameters as primary and secondary sound source codes and first and second parameter codes, respectively, said primary sound source codes conveying said set of the excitation pulses and said subsidiary information signal which are demultiplexed into excitation pulse codes and a subsidiary information code by said demultiplexing means, respectively;

reproducing means coupled to said demultiplexing means for reproducing said primary and said secondary sound source codes into a sequence of driving sound source signals by using said first and said second parameter codes, and said subsidiary information code; and means coupled to said reproducing means for synthesizing said driving sound source signals into said synthesized speech signals.

* * * * *

UNITED STATES PATENT AND TRADEMARK OFFICE

CERTIFICATE OF CORRECTION

PATENT NO. : 5,018,200

DATED : May 21, 1991

INVENTOR(S) : Kazunori OZAWA

It is certified that error appears in the above-identified patent and that said Letters Patent is hereby corrected as shown below:

Col. 8, line 66, delete "$-x_k(n)]$" and insert --$\tilde{x}_k(n)]$--;

Col. 8, line 67, delete "$x_k(n)$" and insert --$\tilde{x}_k(n)$--;

Col. 8, line 67, delete "T" and insert --T'--;

Col. 9, line 15, delete "$x_{wk}(n)\} / \left(\left(\sum_n x_{wk}(n) x_{wk}(n)\right)\right.$" and insert --$\tilde{x}_{wk}(n) / \left(\left(\sum_n \tilde{x}_{wk}(n) \tilde{x}_{wk}(n)\right)\right.$--;

Col. 9, line 20, delete "$x_{wk}$" and insert --$\tilde{x}_{wk}$--;

Col. 9, line 20, delete "T" and insert --T'--;

Col. 9, line 34, delete "$E_k$," and insert --$E_k$'--;

Col. 10, line 4, delete "T" and insert --T'--

Col. 14, line 11, delete "x(n)" and insert --$\tilde{x}(n)$--.

Signed and Sealed this

Eighth Day of June, 1993

*Attest:*

*Attesting Officer*

Michael K. Kirk

MICHAEL K. KIRK

*Acting Commissioner of Patents and Trademarks*